US005263309A

United States Patent [19]

Campbell et al.

[11] Patent Number: 5,263,309

[45] Date of Patent: Nov. 23, 1993

[54] METHOD OF AND APPARATUS FOR BALANCING THE LOAD OF A CABLING APPARATUS

[75] Inventors: Steven R. Campbell, Carrollton, Ga.; Andrew Blackmore, King City, Canada

[73] Assignee: Southwire Company, Carrollton, Ga.

[21] Appl. No.: 880,821

[22] Filed: May 11, 1992

[51] Int. Cl.[5] ..... D01H 13/32

[52] U.S. Cl. ..... 57/264; 57/13; 73/469

[58] Field of Search ..... 57/264, 11, 12, 13, 57/14, 3, 6, 10; 73/460, 461, 462, 468, 469

[56] References Cited

U.S. PATENT DOCUMENTS

| | | | |
|---|---|---|---|
| 1,610,487 | 12/1926 | Brinton | 73/469 |
| 3,010,323 | 11/1961 | Reiser | 73/469 |
| 3,344,392 | 10/1967 | Geisinger | 57/3 |
| 4,407,116 | 10/1983 | Henrich | 57/264 |
| 4,628,675 | 12/1986 | Sakamoto | 57/264 |
| 4,903,473 | 2/1990 | Chassen et al. | 57/264 |
| 5,060,467 | 10/1991 | Gill | 57/264 |
| 5,099,430 | 3/1992 | Hirsch | 73/469 |
| 5,144,792 | 9/1992 | Lange et al. | 57/264 |

*Primary Examiner*—Clifford D. Crowder

*Assistant Examiner*—Larry D. Worrell, Jr.

*Attorney, Agent, or Firm*—Stanley L. Tate; James W. Wallis, Jr.; George C. Myers, Jr.

[57] ABSTRACT

A method of and an apparatus for balancing a multi-bay cabler system when less than all of the cabler frame bays are supplied with a supply bobbin are disclosed. The apparatus comprises a mechanical counterweight system which compensates for a depleting strand supply during operation of the cabler system, thereby equalizing centrifugal loading within the rotating strander frame and maintaining its dynamic balance at full design speed during the cable assembly operation. The counterweight system is installed in a bobbin-carrying cradle of an unused cabler frame bay. According to a first embodiment, the counterweight is driven in a linear path relative to the cradle in a direction normal to the rotational axis of the cabler frame. According to a second embodiment, the counterweight is driven in an arc relative to its supporting cradle. A control system analyzes an out-of-balance condition and effects a repositioning of the counterweight to maintain the rotating cabler frame in dynamic balance as the bobbin supply is payed out from the rotating frame. Alternatively, the control system may include a computer which positions the counterweight based on a control algorithm.

18 Claims, 3 Drawing Sheets

METHOD OF AND APPARATUS FOR BALANCING THE LOAD OF A CABLING APPARATUS

FIELD OF THE INVENTION

The present invention relates to a method of and an apparatus for assembling a multistranded cable of indeterminate length, and more particularly to a method of and an apparatus for balancing the load carried in a planetary cabling system from which a plurality of individual strands are payed out and helically wrapped into a multistranded cable assembly.

DESCRIPTION OF THE PRIOR ART

According to the prior art, multistranded cables such as those used for electrical power transmission purposes are formed by helically winding a plurality of individual strands together and, in some cable configurations, by helically wrapping the strands about a central core strand in closely spaced relationship thereto. Generally, the surrounding strands are wrapped in a continuous helical manner in one or more circumferentially disposed layers. In one type of known apparatus, each helically wrapped strand is drawn from a supply bobbin carried by a rotatable cabler frame. The central core wire, when used, is typically payed off a single supply bobbin mounted upstream of the cabler frame and advanced along the rotational axis of the frame. As the advancing core wire passes through the rotating frame, each of the strands payed out from the frame-mounted bobbins is helically wrapped about the central core strand. Alternatively, the single strand may be employed in a peripheral wrapping fashion after passing through one or more redirecting sheaves. The frame-mounted bobbins may be fixed to the rotating frame or configured for planetary motion relative to the rotating frame.

Multistranded cables are formed in a variety of cross-sectional configurations having differing numbers of strands. A particular configuration of a multistranded cable is determined in part by the number of strands being payed off the frame-mounted supply bobbins and their relative angular placement about the strander frame. Typically, a cabler frame accommodates from three to six supply bobbins each installed in a cradle located in one of a plurality of bays equi-angularly spaced about the frame.

In one exemplary cabler system using six frame-mounted bobbins and a single upstream mounted bobbin, three uninsulated ground wires are payed off three frame-mounted supply bobbins spaced apart at 120 degree intervals. Three insulated wires are payed off the three remaining frame-mounted supply bobbins also spaced apart at 120 degree intervals from one another and equally spaced between the ground wire bobbins. An insulated core wire is payed off the single supply bobbin mounted upstream of the cabler frame. All seven wires are then wound together to form a "quad" electrical transmission cable assembly. In another exemplary cabler system, a two-wire "dual" cable assembly is formed by loading supply bobbins into two of three cradles of a triple-bay cabler frame.

One problem with such prior art cabler systems is that for a variety of cable assembly configurations, such as the aforementioned "dual" cable assembly configuration, one or more cradles on the cabler frame may remain unused during cable assembly. Unless these unused cradles are diametrically opposed, e.g., on a six or four bay strander, dynamic instabilities caused by the resulting unbalanced system will compromise the high speed winding capabilities of the cable assembly system. These dynamic instabilities can propagate into a severely unbalanced condition when large, high capacity bobbins are run at high speed. Accordingly, the running of an unbalanced load results in undesirable stresses on the cabler system, intermittent loading of the drive train of the cabler system and inconsistent regulation of the speed of the system. This problem is particularly troublesome when attempting to manufacture the above-described "dual" cable construction on a three-bay cabler system. Due to the inherent imbalances caused by the absence of a balancing load in the unused cradle of this configuration, production speed must be substantially reduced in order to prevent undue stresses and possible damage to the system. Another problem with the prior art systems is that the overall balance of the cabler frame changes as each bobbin is depleted of its strand supply during a cable assembly run, especially when less than all the supply cradles are in use.

One approach to attenuating the above-described imbalance problem is to install a half-full dummy bobbin in the cradle of the unused cabler frame bay. This approach, however, provides only limited balancing of the cabler system due to the ever-changing strand mass of the remaining operational bobbins. In such arrangement, the system approaches a transient balanced condition when the mass of each operational bobbin is substantially equivalent to the mass of the half-full dummy bobbin. At all other times an imbalanced condition exists.

SUMMARY OF THE INVENTION

It is therefore an object of the present invention to provide a method of and an apparatus for maintaining the dynamic balance of a multi-bay planetary cabler system when less than all of the cabler frame bays are operational.

It is another object of the present invention to provide a method of and an apparatus for maintaining the dynamic balance of a multi-bay planetary cabler system during the manufacture of a "dual" cable assembly, especially at the commencement of the cable manufacturing process.

It is a further object of the present invention to provide a method of and an apparatus for dynamically balancing a multi-bay planetary cabler system to enable its continuous operation at full design speed when less than all of the cabler bays are operational.

It is yet another object of the present invention to provide a method of and an apparatus for dynamically balancing a multi-bay planetary cabler system which attenuates or eliminates the high intermittent drive train loading encountered by the prior art apparatus.

The method and apparatus of this invention are adaptable to various multistranded structure applications, including electrical power transmission cable, tubes or pipes for fluid transmission, the manufacture of textile products, and the like.

The present invention is directed to a method of and an apparatus for dynamically balancing a multi-bay planetary cabler system when less than all of the cabler frame bays of the system are supplied and operational. The unused bay (or bays) is provided with a counterweight apparatus which, when directed by a regulating computer control system based on an algorithm or a feedback control system, is continuously adjusted during the course of the assembly of a multistranded cable to maintain dynamic balance of the cabler frame as the strand supplies are payed out to the cable assembly being constructed.

In the described embodiment, the invention is applicable to a planetary cabler system having three bays, each with a conventional bobbin cradle mounted therein for planetary movement. To manufacture a two wire "dual" cable assembly with this apparatus according to the invention, two of the cradles are supplied with bobbins fully wound with wire. The third cradle is disengaged from the planetary drive train and is rigidly secured against rotation relative to the cabler frame.

The counterweight apparatus is installed in the cradle of the unused cabler frame bay which would otherwise accommodate a bobbin. Either a linearly driven or an angularly driven counterweight embodiment of the present invention is installed in this cradle.

For the linearly driven embodiment, a counterweight is initially located at a fully extended position radially outward of the cradle relative to the rotational axis of the cabler frame, thereby simulating a full bobbin. The counterweight is then driven in a regulated manner by a power screw drive mechanism along a linear or straight line path toward the rotational axis of the cabler frame as the supply bobbins are depleted, thereby maintaining the dynamic balance of the rotating planetary cabler frame. In the angularly driven embodiment, the counterweight is initially located at a fully extended position radially outward of the cradle relative to the rotational axis of the cabler frame, thereby simulating a full bobbin. The counterweight is then rotated in a regulated manner about its own shaft in an arc toward the rotational axis of the cabler frame as the supply bobbins in the cradles are depleted, thereby maintaining the dynamic balance of the rotating planetary cabler frame. In both embodiments, a regulated drive mechanism transmits the motive force needed to vary the position of the counterweight relative to its cradle and to the rotational axis of the cabler frame.

A feedback control system regulates the relative position of the counterweight of both embodiments in order to maintain dynamic balance of the rotating cabler frame during depletion of the supply bobbins. The control system initiates the initial setup of the system including the initial positioning of the counterweight, followed by analysis of any operational out-of-balance condition caused by the depletion of the supply bobbins during cabler system operation, and correction of this condition by repositioning the counterweight accordingly. Alternatively, the control system may be based on a control algorithm having as inputs various machine operating parameters such as supply bobbin capacities, machine gear speeds, product information of the strand product being run through the system, and the amount of strand product present on each bobbin. Balance calculations and counterweight repositioning based thereon are then performed on a continuing basis throughout the cable assembly run.

A major advantage of this invention is the ability to continuously operate a cabler system at its design capacities and running speeds for the entire length of the developing cable assembly, without the limitations of the imbalanced conditions and high intermittent loadings of the drive train mechanisms of the prior art.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
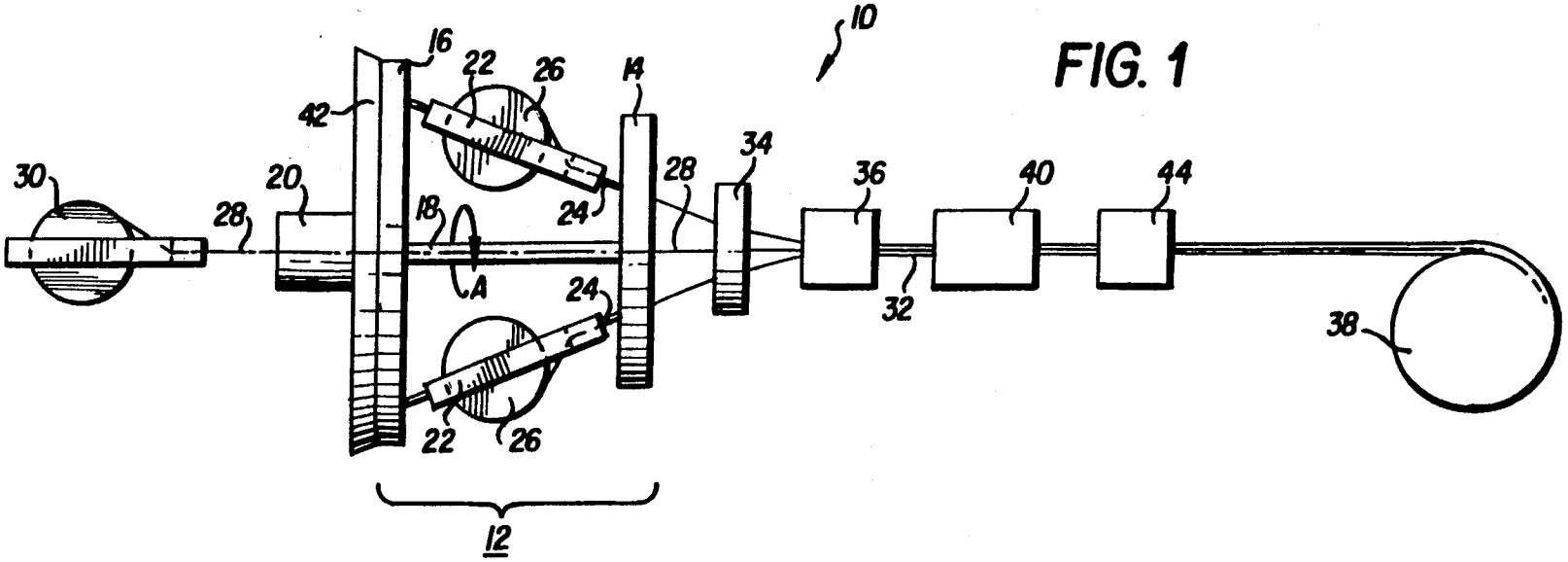
FIG. 1 is a diagrammatic, elevational side view of a planetary cabling apparatus of the invention.

Referring now in detail to the drawings wherein like parts are designated by like reference numerals throughout, there is illustrated in FIG. 1 an exemplary embodiment of the invention incorporated in a planetary cabler apparatus, which is designated generally by reference numeral 10. The apparatus 10 includes a rotatable cabler frame 12 comprising front and rear trunnions 14, 16 respectively, connected together by a central shaft 18 and which is rotated by means of a main drive 20. The trunnions 14, 16 support three or more cradles 22 for planetary movement about the rotational axis A of the central shaft 18. A strand 24 is payed off of each associated supply bobbin 26 supported by a cradle 22 and directed toward and helically wound about an optional central core strand 28. Strand 28 is payed off its associated supply bobbin 30 mounted upstream of the cabler frame 12 and is advanced along the rotational axis A of the rotating frame 12 during operation of the system 10. The peripheral strands 24 and the central core strand 28, should one be included in the cable assembly 32 under construction, are then fed through a lay plate 34 and into a closing block 36.

The advancing cable assembly 32 is wound by a take-up reel 38 after subsequent fabrication steps have been performed, including, for example, applying a jacket or sheathing at a taping head 40 to the cable assembly 32 passing therethrough. A caterpillar drive capstan 44 disposed downstream of the taping head 40 provides the motive force needed to draw the strands 24, 28 and developing cable assembly 32 through the system 10. The drive capstan 44 comprises a caterpillar drive with two or more belts, or a grooved drive wheel, used to effectively tension the strands 24, 28 and cable assembly 32 during cable construction. A planetary gearing system 42 mounted to the upstream side of the rear trunnion 16 is driven by the main drive 20 to rotate the cradles 22 in a planetary manner about axis A as the cabler frame 12 is also rotated about axis A.

Figure 2:
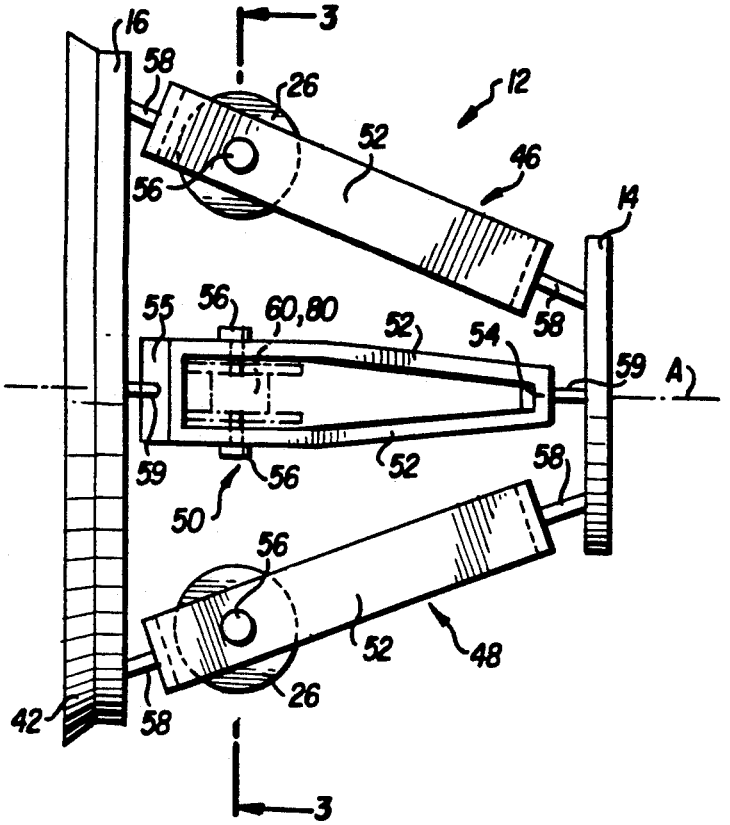
FIG. 2 is a schematic side view of the cabler frame of the apparatus shown in FIG. 1, showing three frame bays containing bobbin cradles, two of which contain bobbins, and the third cradle containing a counterweight balancing apparatus of the present invention.

Now referring to FIGS. 2 and 3, the construction and arrangement of the planetary cabler frame 12 will be described in connection with the manufacture of a "dual" cable assembly in a three bay cabler frame. In this arrangement, three bobbin cradles 46, 48, .50 are mounted between the front and rear trunnions 14, 16 in equi-angularly spaced relation about the cabler frame 12. Each cradle 46, 48, 50 is sized to accommodate either a supply bobbin 26 or one embodiment of the balancing apparatus 60, 80 of the present invention. As will be apparent to those skilled in the art, a cabler frame 12 may accommodate up to six or more cradles. In the instance of higher capacity cablers, one or more of the balancing apparatus 60, 80 may be simultaneously employed.

It will also be appreciated that in cabler frames where the cradles are diametrically opposed, e.g., frames with four, six, eight, etc. cradles, a reasonably balanced load may be achieved where an even number of cradles are used by leaving diametrically opposed cradles unused. Under those limited conditions, the balancing apparatus of the present invention may not be required.

Each cradle 46, 48, 50 comprises a pair of side rails 52 connected by front and rear rails 54, 55, respectively. A pair of retractable pintles 56 is extendable through the side rails 52 of each cradle 46, 48, 50 in opposing relationship such that the pintles 56 together define an axis of rotation. The pintles 56 of cradles 46, 48 are extendable into the central shaft of a supply bobbin 26 to rotatably support a bobbin 26 in its respective cradle. The pintles 56 of cradle 50 support and affix an embodiment of the balancing apparatus 60, 80 of the invention to the cradle 50, as will be further described below. The cradles 46, 48 are rotatably mounted to the front and rear trunnions 14, 16 by means of shafts 58 affixed to the respective front and rear rails 54, 55 of each cradle. Cradles 46, 48 are connected to the planetary gear system 42 (FIG. 1) via the shafts 58 so as to rotate in a planetary manner about rotational axis A as the cabler frame 12 is rotated by main drive 20. The shafts 59 of cradle 50, on the other hand, are disengaged from the planetary gearing and are fixed to the front and rear trunnions 14, 16 in the position shown in FIG. 3. Cradle 50 supports on its pintles 56 one of the embodiments of the counterweight apparatus 60, 80 to maintain the cabler frame 12 in a balanced condition, as will be further described below.

Figure 3:
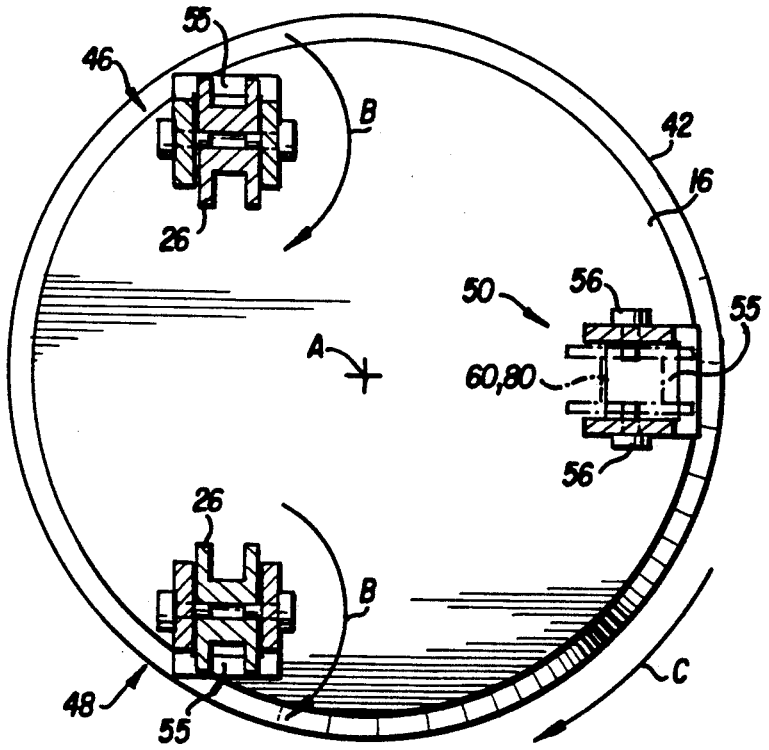
FIG. 3 is a schematic cross-sectional view of the cabler frame shown in FIG. 2, taken along line 3—3.

FIG. 3 illustrates the configuration of the three cradles 46, 48, 50 used in the manufacture of, for example, a "dual" or "duplex" cable assembly. It will be appreciated that the two cradles 46, 48 supporting supply bobbins 26 of this configuration will rotate with a planetary motion relative to the rotational axis A of the cabler frame 12 as shown by the arrows B (FIG. 3). As the frame 12 rotates in the direction shown by the arrow C, the rotation of the cradles 46, 48 in the direction B will maintain the axes of the bobbins 26 parallel to one another and to a given plane, e.g., the horizontal plane. However, since the cradle 50 is fixed to trunnion 16, the balancing apparatus 60, 80 will simply rotate in a rigidly fixed position with the cabler frame 12 so that the axis of the pintles 56 remains perpendicular to a radial plane through axis A intersecting the midpoint of cradle 50.

Figure 4:
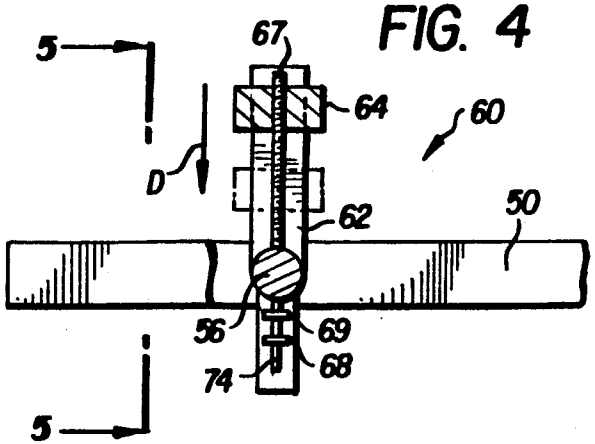
FIG. 4 is a side elevation view, partly broken, of a first embodiment of the present invention, showing the linearly adjustable balancing apparatus.
Figure 5:
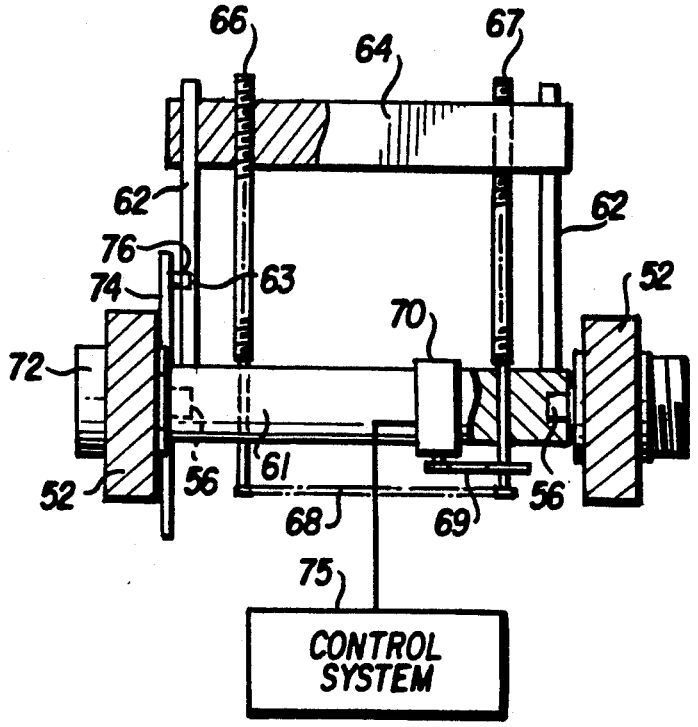
FIG. 5 is a rear elevation view, partly broken of the linearly adjustable balancing embodiment shown in FIG. 4, taken along line 5—5 of FIG. 4.

FIGS. 4 and 5 illustrate the first embodiment of the counterweight apparatus comprising the linearly balancing apparatus 60. Apparatus 60 comprises a central shaft 61 releasably engageable by the pintles 56 so as to be supported between the side rails 52 of the cradle 50 in the same manner as a supply bobbin 26. Affixed to shaft 61 are a pair of spaced apart support arms 62 which support a counterweight 64 for slidable movement therealong. A pair of drive screws 66, 67 are rotatably mounted in bearings (not shown) extending diametrically through shaft 61. Drive screws 66, 67 are rotatably coupled together by a chain 68, and are rotatably driven by a motor 70 mounted to shaft 61. Rotational motive force from the motor 70 is transmitted through a belt 69 to the drive screw 67 and, in turn, to screw 66 via chain 68. The counterweight 64 has a mass which when positioned at its outermost radial position on the support arms 62 closely approximates the dynamic load of a full bobbin 26.

Each of the cradles 46, 48, 50 is provided with a conventional braking mechanism for maintaining tension on the strands 24 being payed out from each bobbin 26. Each conventional braking mechanism 72 includes a tension arm 74 having a locking pin or dog 76 which is engageable in a hole in the flange of a bobbin 26. Thus, as a wire strand is payed out from the rotating bobbin the tension arm 74 rotates with the bobbin. The braking mechanism 72 is selectively applied to retard the rotation of the arm 74 and bobbin so as to maintain a desired degree of tension on the wire strand. The braking mechanisms for the cradles 46, 48 are operated in the aforesaid manner.

In the case of cradle 50 the braking mechanism 72 is used to position the support arms 62 as shown in FIGS. 4 and 5 so that the counterweight can be moved radially inwardly toward the axis A of the cabler frame 12 as the bobbins 26 in cradles 46, 48 are depleted. This is accomplished by engaging the locking pin 76 in a hole 63 in one of the support arms 62 so that the support arms 62 and shaft 61 do not rotate about the axis of pintles 56. The support arms 62 are then positioned as shown in FIGS. 4 and 5 and the brake mechanism 72 is set.

The balancing apparatus 60 of the first embodiment operates in the following manner. As illustrated in FIGS. 4 and 5, the counterweight 64 is initially located at a fully extended position (shown in solid lines) perpendicular to the plane of the cradle 50, thereby simulating a supply bobbin provided with a full supply of strand or wire. As the supply of wire is depleted from bobbins 26 mounted in cradles 46, 48, the counterweight 64 is driven linearly inwardly in the direction of arrow D along support arms 62 by drive screws 66, 67 toward the plane of the cradle 50 and the rotational axis A of the cabler frame 12. When the supply bobbins 26 in cradles 46, 48 have been further depleted, the counterweight 64 will be positioned as shown in dashed lines in FIG. 4. The movement of the counterweight 64 is responsive to an input to motor 70 from a feedback control system 75 which maintains the dynamic balance of the rotating cabler frame 12 and its associated drive train.

The feedback control system 75 regulates the position of the counterweight 64 relative to the cradle 50 by sensing an out-of-balance condition of the cabler frame 12 caused by the depleting supply of wire from the bobbins 26 in cradles 46, 48. The control system 75 then corrects the out-of-balance condition by sending a signal to motor 70 to reposition the weight 64 accordingly. Alternatively, the control system 75 may be based on a control algorithm derived from various system operating parameters such as supply bobbin capacities, system gearing and operating speeds, product information of the strand product being run through the system, the remaining amount of strand product present on each supply bobbin and the like. The control system 75, which may include a computer, such as a personal computer, then positions the weight 64 based on the control algorithm.

Figure 6:
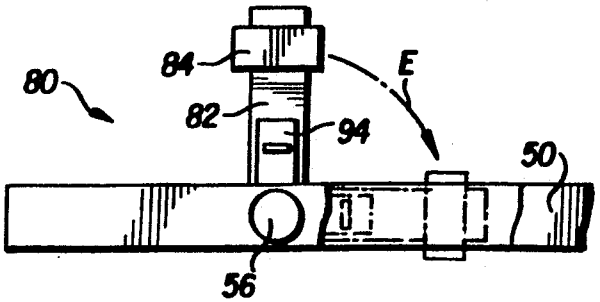
FIG. 6 is a side elevation view, partly broken, of a second embodiment of the present invention, showing the angularly adjustable balancing apparatus.
Figure 7:
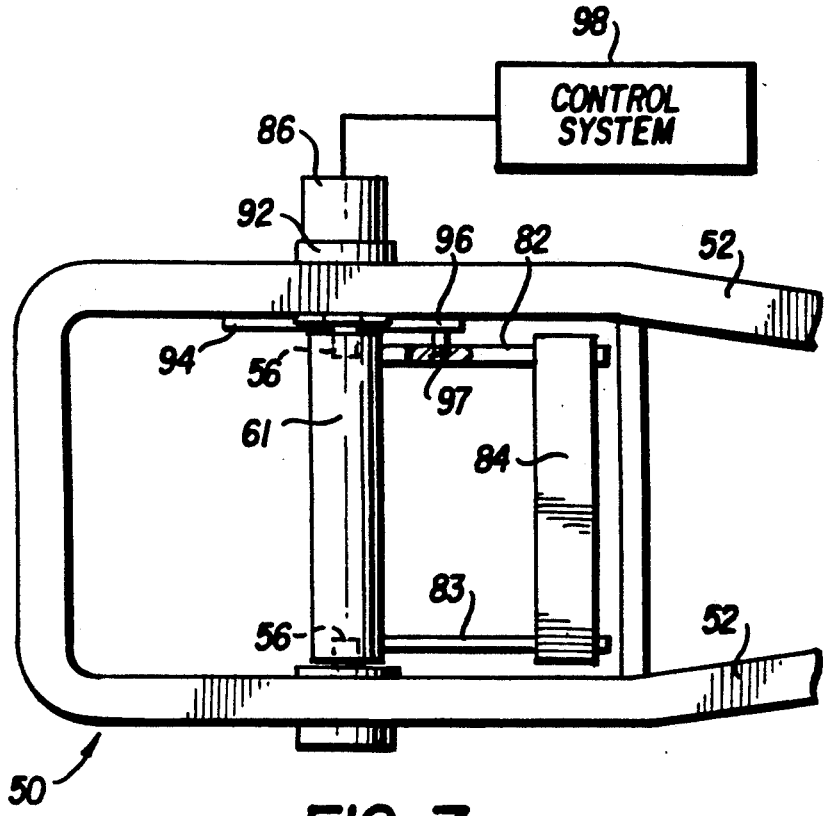
FIG. 7 is a top plan view, partly broken, of the embodiment of the invention shown in FIG. 6.

A second embodiment of the balancing apparatus 80 of the invention is shown in FIGS. 6 and 7 and will be described to the extent this embodiment 80 differs in significant respects from the embodiment of FIGS. 4 and 5. The balancing apparatus 80 comprises the central shaft 61 releasably engageable by the pintles 56 between the side rails 52 of the cradle 50. Affixed to the shaft 61 are a pair of spaced apart support arms 82, 83 which securely support a counterweight 84 at a fixed position near the free ends thereof. A drive mechanism comprising a drive motor 86 and a gear reducer 92 associated therewith is mounted to the cradle 50 in place of the conventional braking mechanism and is connected to the tension arm 74 for angularly positioning the tension arm 74 about the axis of pintle 56. The locking pin or dog 76 of tension arm 74 is engaged in a hole 97 in the adjacent support arm 82 so that operation of the drive mechanism causes the support arms 82, 83 to rotate about the axis of rotation defined by the pintles 56, thereby angularly repositioning the counterweight 84 relative to the cradle 50.

The balancing apparatus 80 of the second embodiment operates in the following manner. As illustrated in FIGS. 6 and 7, the support arms 82, 83 and counterweight 84 are initially located at a fully extended position substantially perpendicular to the plane of the cradle 50 as shown in dashed lines in FIG. 6, thereby simulating a supply bobbin provided with a full supply of strand or wire. As the supply of strand is depleted from bobbins 26 mounted in cradles 46, 48, the arms 82, 83 and counterweight 84 are driven in an arc in the direction of arrow E by the drive mechanism 86, 92 acting toward the plane of the cradle 50 and the rotational axis A of the cabler frame 12 as shown in solid lines in FIG. 6. The angular position of the support arms 82, 83 and counterweight 84 is dependent on the amount of wire strand depleted from the bobbins in cradles 46, 48.

Angular movement of the counterweight 84 and support arms 82, 83 is responsive to an input to drive mechanism 86, 92 from a feedback control system 98 to maintain the dynamic balance of the rotating cabler frame 12 and its associated drive train, as previously described.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for dynamically balancing a varying load of a cabler system, comprising:

a cabler frame having a rotational axis;

a plurality of cradle means for supporting a plurality of supply bobbins in said cabler frame;

drive means for driving said cabler frame about the rotational axis thereof; and balancing means supported by a selected one of said cradle means for dynamically balancing the cabler frame, said balancing means including a counterweight and means for varying a position of said counterweight relative to the rotational axis when said cabler frame is rotated about the rotational axis thereof.

2. Apparatus for dynamically balancing a varying load of a cabler system, comprising:

a cabler frame having a rotational axis;

a plurality of cradle means for supporting a plurality of supply bobbins in said cabler frame;

drive means for driving said cabler frame about the rotational axis thereof, and balancing means supported by a selected one of said cradle means for dynamically balancing the cabler frame, said balancing means including a counterweight and means for varying a position of said counterweight relative to the rotational axis when said cabler frame is rotated about the rotational axis thereof, wherein said selected cradle means is non-rotatably fixed to said cabler frame, and another cradle means being rotatably mounted to said cabler frame and means connected to said drive means for rotating said other cradle means in a planetary manner about the rotational axis of the cabler frame.

3. The apparatus of claim 1, comprising three cradle means.

4. The apparatus of claim 1, wherein said position varying means includes means for moving the counterweight along a linear path toward and away from the rotational axis of the cabler frame.

5. The apparatus of claim 1, wherein said position varying means includes means for moving the counterweight along an arcuate path toward and away from the rotational axis of the cabler frame.

6. The apparatus of claim 1, including control means for determining a dynamic imbalance of the cabler system, for generating an output signal representative of the dynamic imbalance of the cabler system, and for transmitting said output signal to the position varying means to thereby vary the position of the counterweight in response to the dynamic imbalance of the cabler system.

7. The apparatus of claim 6, wherein said control system comprises a feedback control system.

8. The apparatus of claim 6, wherein said control system comprises a computer responsive to a control algorithm.

9. Apparatus for dynamically balancing a varying load of a cabler system, comprising:

a cabler frame having a rotational axis;

a plurality of cradle means for supporting a plurality of supply bobbins in said cabler frame;

drive means for driving said cabler frame; about the rotational axis thereof; and balancing means supported by a selected one of said cradle means for dynamically balancing the cabler frame, said balancing means including a counterweight and means for varying a position of said counterweight relative to the rotational axis when said cabler frame is rotated about the rotational axis thereof, wherein said balancing means further includes support arms supported by said one cradle means, said counterweight being adjustably mounted to said support arms, drive screw means connected between said counterweight and said one cradle means for incrementally moving said counterweight along said support arms, and means for positioning said support arms relative to the rotational axis of the cabler frame.

10. The apparatus of claim 9, wherein said one cradle means includes a pair of pintles, said balancing means further including a shaft rotatably supported by said pintles, said support arms being fixed to said shaft, said positioning means comprising a tension arm rotatably mounted about one of said pintles, a brake operatively connected to said tension arm for braking the rotation of said tension arm and means for releasably coupling one of said support arms to said tension arm whereby the position of said support arms relative to the rotational axis of the cabler frame is fixed at a selected position by setting said brake to prevent rotation of said tension arm.

11. The apparatus of claim 10, wherein said drive screw means comprises a motor fixed to said shaft, a pair of drive screws rotatably mounted to said shaft, said drive screws being threadably connected to said counterweight, said motor being drivingly connected to said drive screws.

12. The apparatus of claim 11, wherein said motor is drivingly connected to a drive screw by a belt, said drive screw being drivingly connected to another drive screw by a chain.

13. The apparatus of claim 1, wherein said selected cradle means includes a pair of pintles, said balancing means further comprises a shaft rotatably supported by said pintles, said counterweight being mounted to a pair of support arms, means connected to one of said support arms for rotating said shaft and support arm about said pintles whereby the position of the counterweight is varied relative to the rotational axis of the cabler frame.

14. The apparatus of claim 13, wherein said means for rotating said shaft and support arms comprises a tension arm mounted for rotation about one of said pintles, said tension arm being releasably connected to one of said support arms and motor means mounted to said one cradle means and connected to said tension arm for rotating said tension arm and support arm about said pintles.

15. A method of balancing a load of a cabler system for making a stranded cable from two or more strands, said cabler system having a cabler frame rotatable about a first axis, a plurality of cradles mounted to said cabler frame, a bobbin wound with a strand supported in one of said cradles, at least one of said remaining cradles having no bobbin, comprising the steps of:

supporting a counterweight in one of said remaining cradles at a first position relative to the first axis;

rotating said cabler frame about the first axis;

paying out said strand from said bobbin; and moving said counterweight to a second position nearer to the first axis than the first position as said strand is payed out from said bobbin to thereby maintain the dynamic balance of the cabler frame.

16. The method of claim 15, including the step of rotating said some of said cradles in a planetary movement about the first axis.

17. The method of claim 15, wherein said moving step comprises the step of moving said counterweight along a linear path.

18. The method of claim 15, wherein said moving step comprises the step of moving said counterweight along an arcuate path.

* * * * *